United States Patent [19]

Beylerian

[11] Patent Number: 4,586,729

[45] Date of Patent: May 6, 1986

[54] MAGNETIC COVERED FOLIO CASE

[76] Inventor: George Beylerian, c/o Beylerian Ltd. 305 E. 63rd St., New York, N.Y. 10021

[21] Appl. No.: 604,724

[22] Filed: Apr. 27, 1984

[51] Int. Cl.[4] ..... B42D 13/00; B42D 1/00; B42D 17/00; B41L 1/20

[52] U.S. Cl. ..... 281/5; 281/2; 281/45

[58] Field of Search ..... 281/2, 5, 45 M, 45; 148/100, 103, 104, 105; 446/137, 138, 139, 29; 63/29 M; 282/11.5 R; 24/153.1

[56] References Cited

U.S. PATENT DOCUMENTS

| | | | |
|---|---|---|---|
| 242,821 | 6/1881 | Farmer | 446/137 |
| 715,162 | 12/1902 | Schwartz | 281/2 |
| 1,187,682 | 6/1916 | Trueman | 282/11.5 R |
| 1,557,170 | 10/1925 | Kaufmann | 281/15 |
| 1,827,964 | 10/1931 | Amsden | 281/5 |
| 1,948,191 | 2/1934 | Shoemaker | 281/5 |
| 2,097,018 | 10/1937 | Chamberlin | 24/153.1 |
| 2,185,392 | 1/1940 | Amdur | 283/105 |
| 2,694,429 | 11/1954 | Berger | 281/5 |
| 3,107,436 | 10/1963 | Edwards | 446/137 |
| 3,719,161 | 3/1973 | Wegner | 281/45 M |
| 4,054,530 | 10/1977 | Deffeyes | 148/105 |
| 4,101,348 | 7/1978 | Berchtold | 148/105 |

FOREIGN PATENT DOCUMENTS

| | | | |
|---|---|---|---|
| 2245760 | 3/1974 | Fed. Rep. of Germany | 281/45 |

*Primary Examiner*—Paul A. Bell
*Assistant Examiner*—Paul M. Heyrana, Sr.
*Attorney, Agent, or Firm*—Robert W. Fiddler

[57] ABSTRACT

A magnetic covered folio case is formed of a pair of magnetizable sheet members forming the covers with oppositely polarized areas on these cover members, so that they will be attracted one to the other when in facing proximity. Arranged between the cover members are a plurality of hingedly attached folio sheets in an accordian folded configuration, with each end folio sheet secured to a cover. Separating the cover members extends the accordian folded folio sheets, exposing the faces of the folio sheets, which may be formed to accommodate writing. There may be secured to the faces of the accordian folded folio sheets one or more pocket forming members to retain articles on said sheets. Sheet and cover member shape may be rectangular, triangular, circular, or of a variety of polygonal shapes. A flap of magnetizable sheet material is hingedly secured to the edge of one cover member to overlie at least a part of the other cover member, and decorative or identifying magnetic sheet elements are provided for selective securement to one or the other of the cover members to appropriately decorate or mark same. A key ring attachment may if desired be attached to one of the covers, and/or a scale rule may be formed on the folio sheets.

20 Claims, 5 Drawing Figures

MAGNETIC COVERED FOLIO CASE

BACKGROUND OF THE INVENTION

This invention relates to the art of folio cases, that is cases holding a plurality of attached sheet members to form either a memo book or diary, stamp or photography album, or the like.

Such folio cases have long been formed employing a pair of cover members, ranging in rigidity from the fairly flexible to the stiff and unbendable. Between these cover members, the folio sheets to be contained are secured. In forming folio cases, particularly those which are subject to being moved about, consideration is given to insuring the fact that the cover members will maintain their position relative to the closed folio sheets to protect and retain them in desired position, while at the same time providing ready access to these sheets when desired. Further, it is often desired to provide means for marking or decorating the cover of the case. Additionally, it is often desired to support sheet articles such as stamps or pictures in the folio with both surfaces of the sheet article protected and/or to retain keys in association therewith and/or to provide means for measuring.

BRIEF DESCRIPTION OF INVENTION

It is with the above considerations in mind that the present improved folio case has been evolved, serving to provide secure retention and protection for the folio sheets, while at the same time permitting easy access to the sheets when desired, permitting supporting of a sheet article on the folio sheet, and providing selectively changeable decorative or identifying indicia on the case cover, along with key retaining means and/or measuring means.

It is accordingly among the primary objects of the invention to provide an improved folio case serving to securely retain and protect folio pages within the case, while permitting ready access thereto when desired.

Another object of the invention is to provide an improved folio case which, facilitates retention of keys.

It is also an object of the invention to provide a folio case serving to retain a scale rule.

A further object of the invention is to provide an improved folio case to which desired decorative or identifying indicia may be selectively applied.

An additional object of the invention is to provide a folio case which may support sheet articles, such as stamps or pictures with both surfaces of said sheet articles covered.

These and other objects of the invention which will become hereafter apparent are achieved by forming a folio case with magnetizable covers formed of a sheet material, such that areas of opposed covers will be oppositely polarized, so that the covers when brought into facing proximity will be attracted one to the other. A plurality of hingedly attached folio sheets are arranged and secured between said cover members in an accordian folded configuration, and pocket forming elements may, if desired, be secured to said folio sheets. A flap of magnetizable sheet material is hinged to one cover to permit it to overlie at least a part of the other cover when the covers are brought together to further insure case closure. Magnetized elements may be selectively applied to the covers to provide a desired decoration or identifying indicia on said covers. A key attaching element may if desired be formed on one of the magnetizable covers, and if desired slots may be formed extending across the folio sheets with the indicia of a scale rule arranged adjacent the slots.

BRIEF DESCRIPTION OF THE DRAWINGS

The specific details of the best mode contemplated by applicant for carrying out the invention and of the manner and process of making and using it so as to enable those skilled in the art to practice same will be described in clear, concise and exact terms, in conjunction with the following drawings, wherein.

DESCRIPTION OF PREFERRED EMBODIMENT

Figure 1:
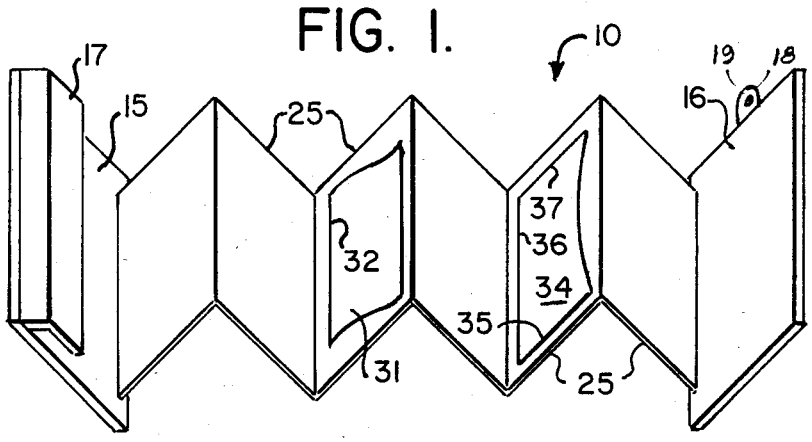
FIG. 1 is a perspective view of a magnetic covered folio case made in accordance with the teachings of the invention shown with the covers separated to expose the accordian folded folio sheets.

Referring now more particularly to the drawings, where like numerals in the various FIGS. will be employed to designate like parts, as best seen in FIG. 1, a folio case 10 embodying the invention is illustratively shown as formed with a pair of spaced magnetizable cover members 15, and 16, as shown one on the extreme left, and the other, to the extreme right of FIG. 1. The magnetizable cover members 15 and 16 are preferably formed of a magnetizable sheet material, as described below, with oppositely polarized areas, so that the covers will be drawn towards each other when in facing proximity.

Figure 2:
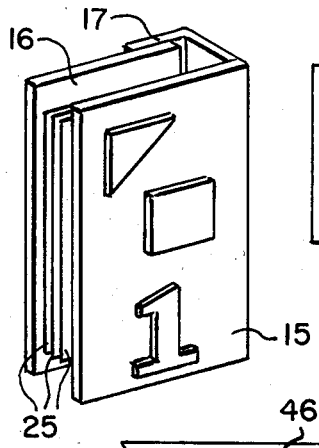
FIG. 2 is a perspective view of a folio case of the type shown in FIG. 1, shown in closed condition and illustrating on the cover some removable decorative or identifying indicia.

A flap 17 similarly formed of a magnetic sheet material having areas of opposite polarity to the cover opposed to the one to which it is hinged is secured to the free edge of one of the flaps, as best seen in FIGS. 1 and 2.

A tab 18 having an aperture 19 may be formed on one of the cover members, 16 as seen in FIG. 1, to permit attachment to a key chain or ring.

Figure 3:
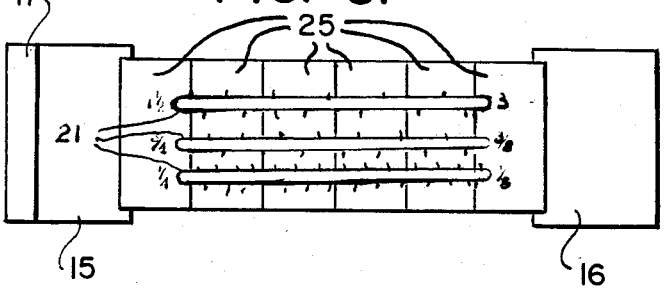
FIG. 3 is a top plan view of a folio case of the type shown in FIG. 1, in completely extended position, illustrating the rectangular contours of the folio sheets which are here shown as provided with elongate slots marked with indicia to provide different scales.

If desired as shown in FIG. 3, a scale rule may be provided by forming slots 21, with indicia corresponding to a scale rule along the slot edges.

Secured between one edge of cover member 15 and cover member 16 are a plurality of hingedly attached folio sheets 25, which, as seen in FIG. 1, are arranged in an edge to edge relationship to form an accordian folded configuration. These folio sheets, as best seen in FIG. 3, though geometrically similar in shape to that of the covers, are preferably slightly smaller.

According to the invention, the folio sheets may be provided as desired with pocket forming elements which may be selected of different types. Thus, to the left in FIG. 1, a pocket forming element 31 is illustratively shown formed of a sheet of transparent material only one edge 32 of which is adhered to the folio sheet 25 in connection with which it is positioned. Another form of pocket forming elements 34, as seen to the right in FIG. 1, is similarly formed of a sheet material, preferably transparent, and secured to folio sheet 25 along three edges 35, 36 and 37 of the pocket 34, leaving one side open between the pocket forming element 34 and the folio sheet 25.

As best seen in FIG. 2, one or more selectively applicable and removable decorative and/or identifying elements (three being here illustratively shown) 40, 41, and 42, formed of a magnetic sheet material, are provided for securement to the exterior surfaces of one or both covers 15 and 16 of the folio case.

Figure 4:
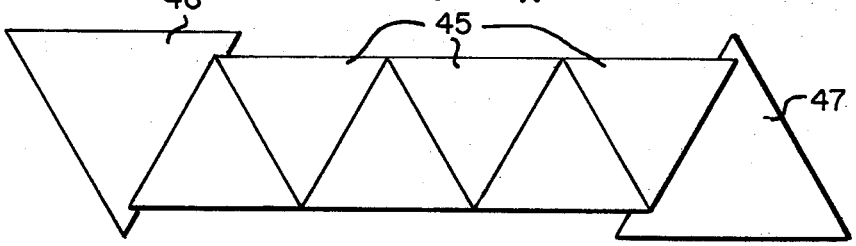
FIG. 4 shows a top plan view of another embodiment of the folio case utilizing triangular shaped folio sheets and case cover members.

In the embodiment illustrated in FIG. 4, the folio sheets 45 are shown as formed of a triangular configuration. Cover elements 46 and 47 are illustratively shown as geometrically similar to the folio sheets of a triangular configuration slightly larger than that of the folio sheets 45, to be encased therebetween. As in the embodiment of FIGS. 1–3, cover members 46 and 47 are made of magnetic sheet material magnetized with areas of opposed polarity with respect to each other so as to facilitate drawing of one cover relative to the other when they are brought into facing proximity.

Figure 5:
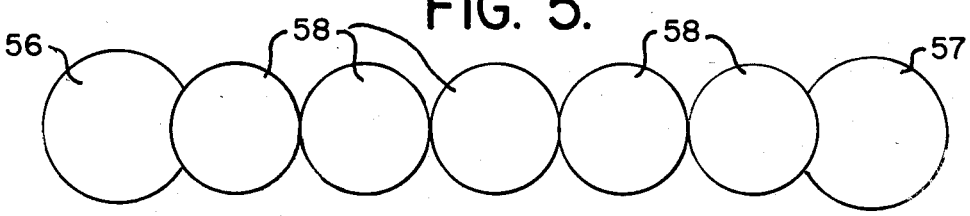
FIG. 5 shows a plan view of another embodiment of the folio case with the folio sheets and covers in extended open position shown utilizing circular folio sheets and case covers.

In the embodiment of the invention illustrated in FIG. 5, the cover members 56, 57 and the folio sheets 58 are formed of a circular configuration, with the cover members 56 and 57 being slightly larger in diameter than that of the folio sheets 58. As in connection with the cover members 15 and 16 of the FIG. 1–3 embodiment, cover members 56 and 57 are formed of a magnetizable sheet material having oppositely polarized areas drawing one cover member toward the other when they are brought into facing proximity.

The folio sheets may be made of any of a variety of conventional sheet materials, such as paper or sheet plastic. The cover members are made of a magnetizable sheet material, which may be formed in accordance with the invention, preferably by impregnating sheet plastics such a vinyl or polyvinyl with ferromagnetic particles. Alinico powder and/or iron filings embedded in the plastic during formation of the plastic has been found to produce eminently satisfactory magnetizable qualities in the sheet material. Alternatively, the sheet material may be formed by a laminate of plastic or paper sheeting surrounding a central foil of ferromagnetic materials, such as sheet steel or the like.

Where the folio is to be employed for holding stamps, photographs or the like items, commonly held so that they are subject to ready visual inspection and subsequent removal, it is preferred to form the folio sheets of a sheet plastic material such as sheet vinyl, and provide a pocket forming element such as element 31, which comprises a flap of transparent sheet material of a similar plastic. It is found that the conventionally calendered smooth surfaces of these sheet plastics provide a relative surface adhesion therebetween, so that when the pocket forming element is lifted and a picture or stamp is inserted between the pocket forming element and the folio sheet, the element 31 will provide a protective overlying flap or pocket for the picture or stamp. Alternatively, the pocket forming element may be sealed along three sides as in element 34 shown in FIG. 1.

In forming the above described folio case, the folio sheets are preferably cut as a single element from a length of sheet stock, and provided with fold lines between the areas desired to form the folio sheets.

In the embodiment illustrated in FIGS. 1–3, this may be accomplished by continuously cutting and scoring the desired strip of folio sheets from a large sheet of stock sheet material, utilizing a conventionally available cutting and scoring roll so as to simultaneously cut the strip of folio sheets and score the desired fold lines along which hinging is to take place to provide the desired accodian folded group of folio sheets 25, which is illustrated in FIGS. 1–3.

Where a triangular or circular configuration is desired for the folio sheets, this may similarly be accomplished by cutting and scoring a continuous sheet to form a strip of accordian folded folio sheets, as shown in FIGS. 4 and 5.

After the cut and scored sheets forming the folio sheets are formed, cover elements of desired shape are secured thereto formed of the above described magnetic material.

OPERATION

As will be apparent to those skilled in the art, after forming the desired folio case as above described, the case may be utilized for any of the myriad purposes for which folio cases have conventionally been employed.

Thus, where it is desired to employ the folio case for memorandum or diary entry purposes, the requisite number of sheets are provided formed of sheet material such as paper, on which written entries may readily be inscribed.

Where the case is intended for use as an album for photographs, coins or stamps, it is preferred to make the folio sheets of a plastic sheet material, and provide same with desired pocket forming elements, which are preferably transparent.

In use, as is apparent, when the covers are brought together, the oppositely polarized areas on these covers are brought together, one to the other, sandwiching the accordian folded sheets therebetween to provide a compact, secure package, as seen in FIG. 1, in which the sheets are held flat, with any items positioned thereon maintained securely. Flap 17 when folded over from one cover to the other provides further security.

When it is desired to expose the folio sheets, the application of sufficient manual force to the covers to separate them to overcome their magnetic attraction brings them apart, serving to permit the folio to be opened to the position shown in FIGS. 3, 4 or 5.

The above disclosure has been given by way of illustration and elucidation and not by way of limitation, and it is desired to protect all embodiments of the herein disclosed inventive concept within the scope of the appended claims.

What is claimed is:

1. A magnetic covered folio case comprising:

a pair of magnetizable cover members having oppositely polarized areas drawing one cover member towards the other when they are brought into facing proximity;

a plurality of hingedly attached folio sheets arranged edge to edge between said cover members in an accordian folded configuration; and pocket forming elements on at least some of said sheets.

2. A magnetic covered folio case as in claim 1, in which a closure flap formed of magnetizable sheet material is hinged to one cover of said pair of cover members to permit it to overlie at least a part of the other of the covers of said pair of cover members.

3. A magnetic covered folio case as in claim 1, in which a decorative element is magnetically held on at least one of the covers of said pair of cover members.

4. A magnetic cover folio case as in claim 1, in which each of said cover members is of a rectangular configuration, each congruent to the other, and larger in area than the area of each of said folio sheets.

5. A magnetic covered folio case as in claim 1, in which said cover members are formed of a flexible sheet plastic material containing magnetizable particles.

6. A magnetic covered folio case as in claim 5, in which said sheet plastic material is vinyl and said magnetizable particles are Alinico powder.

7. A magnetic covered folio case as in claim 5, in which said magnetizable particles are iron.

8. A magnetic covered folio case as in claim 1, in which said cover members comprise a laminate of ferromagnetic sheet material sandwiched between sheet plastic.

9. A magnetic covered folio case as in claim 8, in which said sheet plastic is vinyl and said ferromagnetic sheet material is steel.

10. A magnetic covered folio case as in claim 1, in which said pocket forming elements comprise transparent flexible sheet cover members hinged to and overlying said hingedly attached folio sheets.

11. A magnetic covered folio case as in claim 10, in which said pocket forming element and said folio members are formed of a material having a surface adhesion therebetween.

12. A magnetic covered folio case as in claim 1, in which said pocket forming elements are of a rectangular configuration and secured to said folio sheets along three sides of said elements.

13. A magnetic covered folio case as in claim 1, in which said cover members and folio sheets are of rectangular configuration, with said folio sheets slightly smaller than said cover members.

14. A magnetic covered folio case as in claim 1, in which said cover members and folio sheets are of triangular configuration.

15. A magnetic covered folio case as in claim 1, in which said cover members and folio sheets are of a circular configuration.

16. A magnetic covered folio case as in claim 1, in which said folio sheets are hinged along parallel hinge lines.

17. A magnetic covered folio case as in claim 1, in which said cover members and folio sheets are of a polygonal configuration.

18. A magnetic covered folio case as in claim 1, in which a plurality of decorative elements formed of a magnetizable material are arranged on said cover member, polarized for attraction thereto, and subject to selective positioning to obtain such decorative or information identifying patterns as may be desired.

19. A magnetic covered folio case comprising:

a pair of magnetizable cover members having oppositely polarized areas drawing one cover member towards the other when they are brought into facing proximity;

a plurality of hingedly attached folio sheets arranged edge to edge between said cover members in accordian folded configuration; and a key engaging element on at least one cover member.

20. A magnetic covered folio case comprising:

a pair of magnetizable cover members having oppositely polarized areas drawing one cover member towards the other when they are brought into facing proximity;

a plurality of hingedly attached folio sheets arranged edge to edge between said cover members in an accordian folded configuration at least one slot on at least one sheet having spaced indicia along at least one edge thereof whereby said slotted sheet may be employed as a scale.

* * * * *